US006117776A

United States Patent [19]

Huber et al.

[11] Patent Number: 6,117,776

[45] **Date of Patent: *Sep. 12, 2000**

[54] WAFER HOLDER AND METHOD OF PRODUCING A SEMICONDUCTOR WAFER

[75] Inventors: Anton Huber, Burghausen; Robert Drexler, Hitzenau, both of Germany

[73] Assignee: Wacker Siltronic Gesellschaft für Halbleitermaterialien AG, Burghausen, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 09/086,855

[22] Filed: May 29, 1998

[30] Foreign Application Priority Data

May 30, 1997 [DE] Germany ..... 197 22 679

[51] Int. Cl.[7] ..... H01L 21/302; H01L 21/461

[52] U.S. Cl. ..... 438/691; 438/692

[58] Field of Search ..... 438/691, 692, 438/693; 456/345; 216/88; 451/287, 288, 398, 41

[56] References Cited

U.S. PATENT DOCUMENTS

| | | | |
|---|---|---|---|
| 4,239,567 | 12/1980 | Winings . | |
| 4,597,228 | 7/1986 | Koyama et al. . | |
| 5,316,620 | 5/1994 | Hasegawa et al. | 156/345 |
| 5,400,548 | 3/1995 | Huber et al. . | |
| 5,429,711 | 7/1995 | Watanabe et al. | 438/692 |
| 5,618,227 | 4/1997 | Tsutsumi et al. | 451/288 |
| 5,756,399 | 5/1998 | Hajime et al. | 438/692 |
| 5,851,924 | 12/1998 | Nakazawa et al. | 438/691 |
| 5,891,353 | 4/1999 | Masumura et al. | 216/88 |
| 5,895,583 | 4/1999 | Augustine et al. | 216/53 |
| 5,914,053 | 6/1999 | Masumura et al. | 438/691 |
| 5,961,372 | 10/1999 | Shendon | 451/41 |

FOREIGN PATENT DOCUMENTS

| | | |
|---|---|---|
| 0699504 | 8/1995 | European Pat. Off. . |
| 0751553 | 5/1996 | European Pat. Off. . |

*Primary Examiner*—Benjamin L. Utech
*Assistant Examiner*—Duy-Vu Deo
*Attorney, Agent, or Firm*—Collard & Roe, P.C.

[57] ABSTRACT

A wafer holder chuck has support for fixing a semiconductor wafer during grinding. There is a method of producing a semiconductor wafer which has two flat-ground sides and a rounded edge. The wafer holder has a support which is composed of a soft material. The method has the semiconductor wafer fixed on a wafer holder having a soft support during grinding of the first side and has the wafer fixed on a wafer holder having a hard support during grinding of the second side.

7 Claims, 2 Drawing Sheets

1
2
5

1
2
3
4
5

1
2
5

1
2
3
4
5

1
2
5

1
2
5

6
1
2
5
4
7
3

1
2
5

1
5
4
2
3

1
5
2

WAFER HOLDER AND METHOD OF PRODUCING A SEMICONDUCTOR WAFER

BACKGROUND OF THE INVENTION

1. Field of the Invention

The present invention relates to a wafer holder and a method of producing a semiconductor wafer with ground sides and a rounded edge, in which the wafer holder is used.

2. The Prior Art

The production of a semiconductor wafer comprises the cutting of the semiconductor wafer from a crystal and a series of material-removing machining steps. Suitable as cutting tools are Inner Diameter, band and wire saws. If a wire saw is used, a plurality of semiconductor wafers can be cut simultaneously from a crystal. Wire-sawed semiconductor wafers are severely contaminated after the cutting operation because of the sawing suspension used in wire sawing. Regardless of the cutting method used, a semiconductor wafer cut from a crystal has damage in the near-surface region which has to be removed by subsequent material-removing machining steps. These machining steps are also necessary in order to provide the semiconductor wafer with a rounded edge, with as smooth a surface as possible and with parallel sides. After the cutting operation, the thickness variation of the semiconductor wafer, the flatness of its side surfaces and the structure of its edge still do not meet the requirements necessary for the subsequent processing of the semiconductor wafer to produce electronic components. The material-removing machining steps normally include the edge rounding, lapping, etching and polishing of the cut semiconductor wafer.

It has also been proposed to replace the lapping in which both sides of the semiconductor wafer are machined simultaneously by two grinding steps. These two grinding steps are to be carried out one after the other wherein one side of the semiconductor is ground in each case. U.S. Pat. No. 5,400,548 describes such a grinding method. During the grinding, the semiconductor wafer lies on the support of a wafer holder or chuck. Standard wafer holders have a support made of porous ceramic material. The semiconductor wafer is fixed to the wafer holder by vacuum suction. That side of the semiconductor wafer is ground which is opposite to the side lying on the wafer holder. During edge rounding, the edge of the semiconductor wafer is ground.

The grinding of the sides of the semiconductor wafer achieves a good parallelism for the surfaces of the sides. On the other hand, it has been determined that the flatness of the sides thereby obtainable does not meet the necessary requirements. In order to achieve the desired flatness, subsequent material-removing machining steps, such as etching and polishing, have to take a more expensive form. Accordingly, the material removal to be included in the calculation for the production of a semiconductor wafer with desired wafer shape increases so that the wafer yield for a certain crystal length decreases.

During grinding or edge rounding of a semiconductor wafer, undesirable material splintering must be expected on that side of the semiconductor wafer situated opposite the wafer holder. This splintering has been referred to as crow's feet. Another phenomenon which impairs the quality of the semiconductor wafer relates to local depressions or dimples on the sides of the semiconductor wafer which can be produced during the grinding of the sides. Crow's feet and depressions are likely to occur, if the semiconductor wafer to be machined is contaminated with particles. Wire-sawed semiconductor wafers, in particular, therefore have to be laboriously cleaned prior to grinding or edge rounding.

SUMMARY OF THE INVENTION

It is an object of the present invention to achieve the result that a semiconductor wafer can be ground and edge-rounded even if it has been initially crudely cleaned and even its surface is still appreciably contaminated with particles without the difficulties described above having to be expected.

This object is achieved by the present invention which relates to a wafer holder or chuck having a support for fixing a semiconductor wafer during grinding wherein the support is composed of a soft material.

The wafer holder of the invention differs from known wafer holders in that the material of which this support is made preferably has an organic nature and is softer than the rigid ceramic material previously used. The material must be soft enough for particles which are situated between the semiconductor wafer and the wafer holder to be embedded in the support of the wafer holder by the compression force exerted during the fixing of the semiconductor wafer. In addition, the material must be soft enough for the semiconductor wafer not to be deformed but for the support to be elastically deformed. This is true even if an uneven side of the semiconductor wafer is laid on the surface of the support and is fixed on the wafer holder. The material of the support should have a Shore A hardness of 5 to 99, preferably 50 to 92 and particularly preferably 80 to 90.

It is furthermore preferable that, prior to the use of the wafer holder, the support is surface-ground such that the support has a surface which is as flat as possible. The support of the wafer holder is preferably composed of an elastic organic material having a porous structure. Particularly preferred is a material such as, polyurethane, for example, polyurethane foam. The support may, for example, be stretched over or glued to the wafer holder. If the semiconductor wafer is fixed on the wafer holder by means of vacuum suction, it is desirable to provide the support beforehand with suction channels, for example by perforating it at a plurality of points.

The present invention also relates to a method in which the wafer holder is used. The method is one wherein the semiconductor wafer is fixed on a wafer holder having a soft support during grinding of the first side and is fixed on a wafer holder having a hard support during grinding of the second side.

In connection with the invention, a support is described as hard if an uneven side of a semiconductor wafer lies on the surface of the support and the semiconductor wafer is elastically deformed during fixing on the wafer holder. These hard supports are composed of inorganic material, in particular ceramic material. The Shore A hardness of such a material is preferably above 99.5.

BRIEF DESCRIPTION OF THE DRAWINGS

Other objects and features of the present invention will become apparent from the following detailed description considered in connection with the accompanying drawings which disclose the embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figures 1, 1A, 1B, 1C, 1D, 1E:
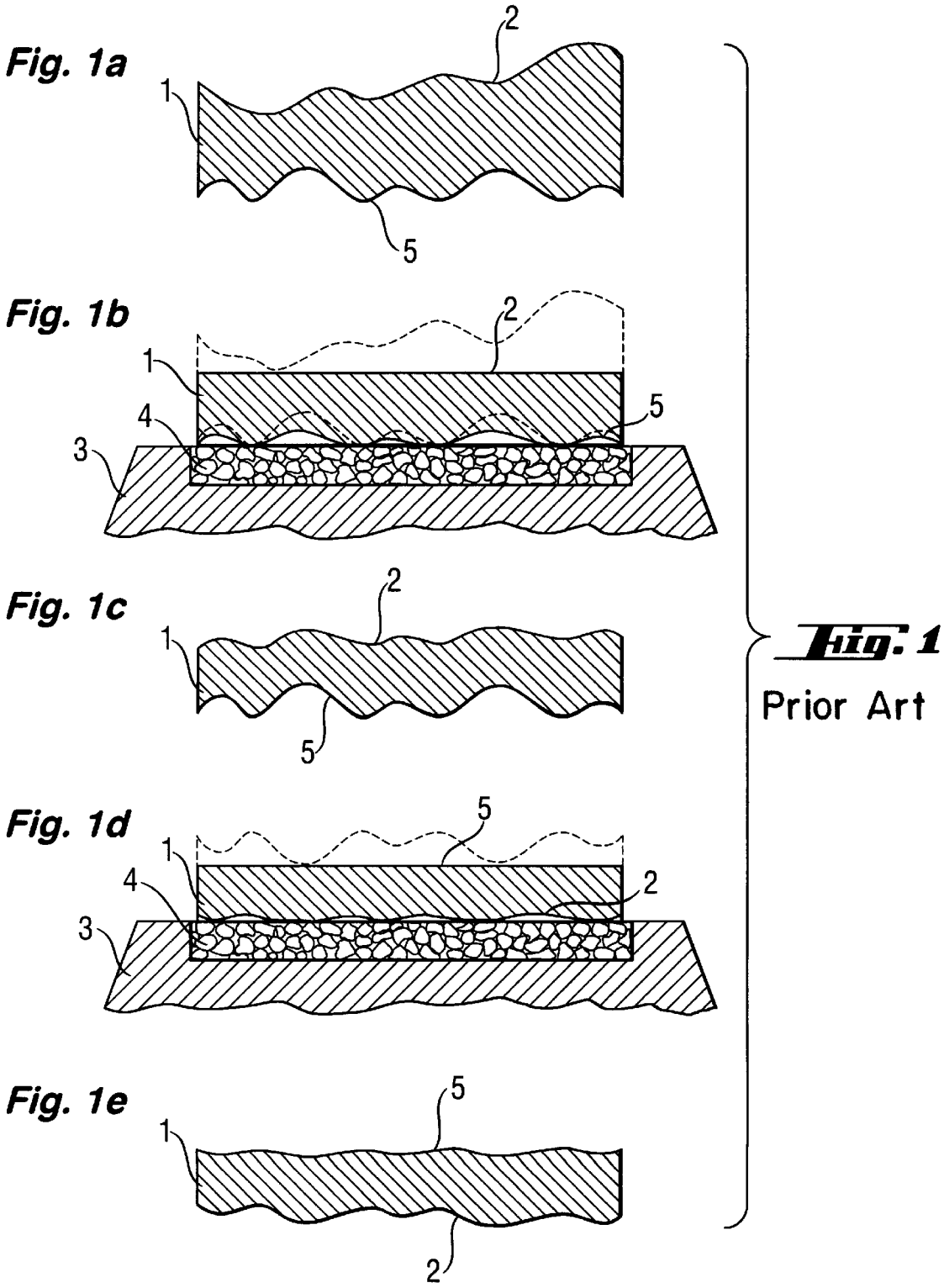
Fig. 1 Prior Art
FIG. 1 shows diagrammatically the operations (luring grinding of the sides of a semiconductor wafer if a standard prior art wafer holder having hard support is used.
FIG. 1*a* shows a semiconductor wafer which has been cut from a crystal and which has neither flat nor parallel sides.
FIG. 1*b* shows that if the semiconductor wafer is laid on the hard support of a wafer receptacle and is fixed thereon, the uneven back of the semiconductor wafer is pressed against the support.
FIG. 1*c* shows that the ground front flat side becomes undulating again as soon as the fixing of the semiconductor wafer is removed and the elastically deformed semiconductor wafer can relax.
FIG. 1*d* shows that the semiconductor wafer is elastically deformed again as soon as its front is fixed on the hard support of the wafer holder.
FIG. 1*e* shows that after grinding the back, a semiconductor wafer is obtained whose sides have the desired parallelism, but still have an undesirably high residual undulation, according to the prior art.

Turning now in detail to the drawings, reference is first made to FIG. 1. The operations shown during grinding of the sides of a semiconductor wafer are a description of the prior art. As can be gathered from FIG. 1*a*, a semiconductor wafer 1 which has been cut from a crystal has neither flat nor parallel sides. The sides have an undulating profile and the wafer thickness varies radially over the wafer diameter. One side of the semiconductor wafer is described below as front 2 and the side situated opposite it as back 5. If the semiconductor wafer 1 is laid on the hard support 4 of a wafer receptacle 3 and is fixed thereon, for example by vacuum suction (FIG. 1*b*), the uneven back 5 of the semiconductor wafer is pressed against the support 4. In this process, the semiconductor wafer is elastically formed and fits snugly against the surface of the support. Undulating uneven regions on the back are partly smoothed out and partly reduced in amplitude. A particle which is situated between the support and the semiconductor wafer deforms the wafer, as a result of which the amplitude of the undulation on the front of the semiconductor wafer situated opposite the particle is locally increased. If the compression force originating from the particle exceeds a certain value, material chips off at this point and a crow's foot is produced. This situation may occur both during grinding of the sides of the semiconductor wafer and during rounding of the edge of the semiconductor wafer. This rounded edge is between the two sides of the wafer.

The grinding of the front of the semiconductor wafer does indeed initially produce a flat side. The ground front flat side becomes undulating again, however, as soon as the fixing of the semiconductor wafer is removed and the elastically deformed semiconductor wafer 1 can relax (FIG. 1*c*). In the subsequent grinding step, the back 5 of the semiconductor wafer is ground, while the front 2 of the semiconductor wafer is fixed on the hard support 4 of the wafer holder 3. Although the undulation of the front is reduced by the first grinding step, it is not completely removed. The semiconductor wafer is therefore elastically deformed again as soon as its front 2 is fixed on the hard support 4 of the wafer holder 3 (FIG. 1*d*). If the fixing of the semiconductor wafer is removed after grinding the back, a semiconductor wafer 1 is obtained whose sides already have the desired parallelism, but still have an undesirably high residual undulation (FIG. 1*e*).

If a particle is situated between the semiconductor wafer and the wafer holder during the grinding of the semiconductor wafer, it will locally deform the semiconductor wafer. Thus, too much material is ground off at this point and a depression, or dimple, is produced on the side of the semiconductor wafer (not shown).

Figures 2, 2A, 2B, 2C, 2D, 2E:
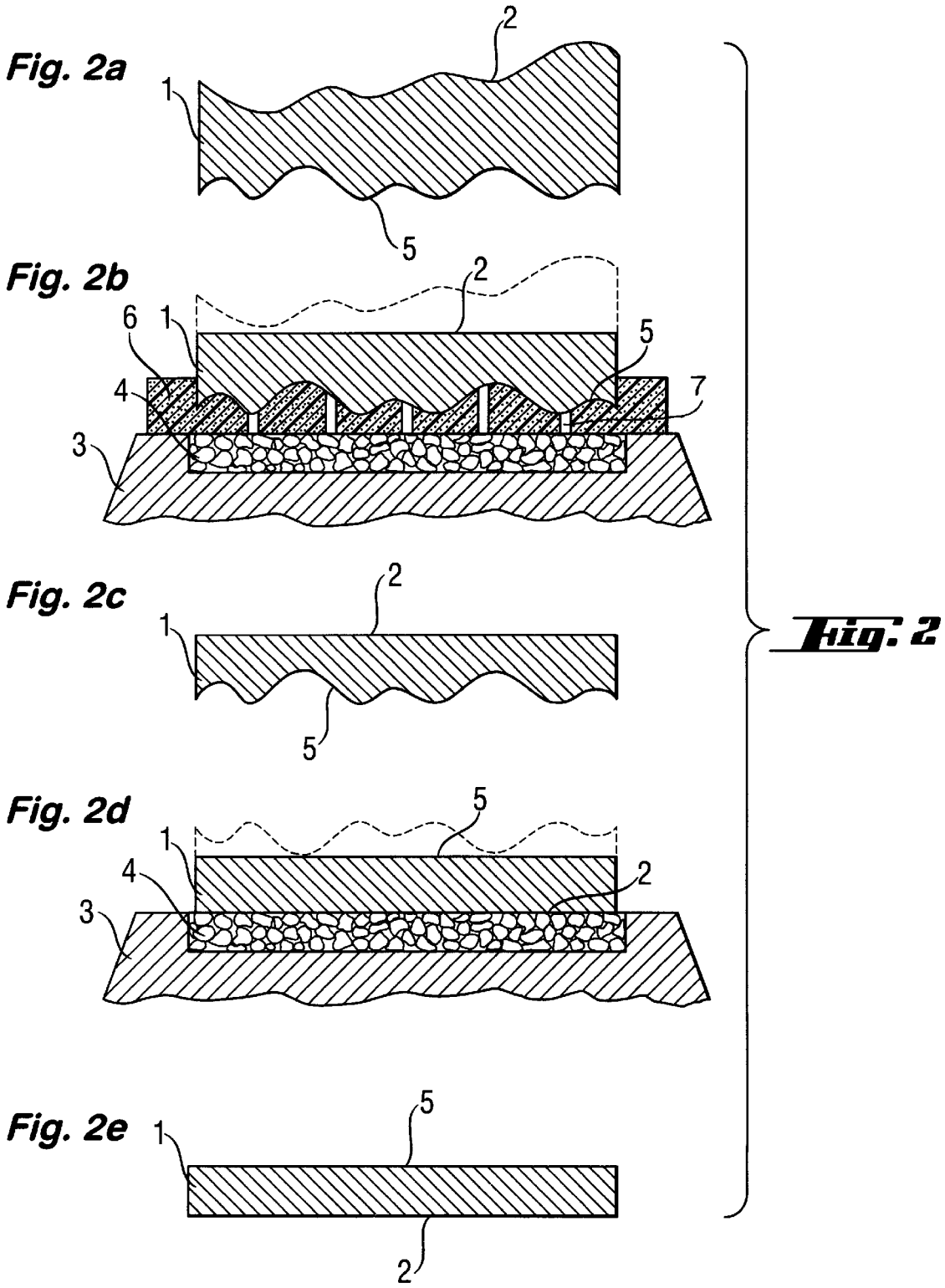
FIG. 2 shows a sequence of steps during the grinding of a semiconductor wafer that is ground in accordance with the invention.
FIG. 2*a* shows that the sides of the semiconductor wafer cut from a crystal are not flat and do not lie parallel to one another.
FIG. 2*b* shows that the uneven regions on the back of the semiconductor wafer are taken up by the soft support during the grinding of the front.
FIG. 2*c* shows that the semiconductor wafer fixed on the wafer holder is not elastically deformed so that the first grinding step results in a flat front which remains intact even after the semiconductor wafer is removed from the wafer holder.
FIG. 2*d* shows that as a result of using a wafer holder having a hard support, the back of the semiconductor wafer can be ground parallel to the reference face with high precision.
FIG. 2*e* shows that the semiconductor wafer retains its flat- and parallel-ground sides even after removal from the wafer holder, according to the invention.

The method according to the present invention provides that, in order to grind the first side, which is the front side, the semiconductor wafer is fixed on a wafer holder having a soft support 6. This is shown in FIG. 2. The sides of the semiconductor wafer 1 cut from a crystal are not flat and do not lie parallel to one another (FIG. 2*a*). The semiconductor wafer may quite easily be contaminated with particles without crow's feet and depressions being produced during grinding or edge rounding. Even heavily contaminated wire-sawed semiconductor wafers only have to be cleaned crudely initially before grinding. It is sufficient to rinse the sawing suspension off to such an extent that its liquid constituents are removed in the process. Particles which are situated between the semiconductor wafer and the support even after wafer cleaning are forced into the soft support 6 when the semiconductor wafer 1 is fixed on the wafer holder 3 without deforming the semiconductor wafer. The uneven regions on the back 5 of the semiconductor wafer are likewise taken up by the support during the grinding of the front 2 (FIG. 2*b*).

The semiconductor wafer can be fixed onto the wafer holder by means of applying a vacuum suction. Thus it is desirable to provide the soft support 6 beforehand with suction channels 7 therethrough, for example by perforating the soft support 6 at a plurality of points. Hence, the vacuum suction is applied to the wafer through the suction channels 7.

The soft support is, for example, glued to a conventional wafer holder or stretched over it. A conventional wafer holder may also be used in which the hard support is replaced by a soft support. It is preferable that the soft support on the wafer holder is surface-ground at least once to render it even before the wafer holder is used for machining semiconductor wafers. It is also desirable to cleanse the soft support of particles after every wafer machining, for example by means of a brush. Cleaning of the ground front is furthermore preferred. This cleaning can be carried out in the grinding machine with the semiconductor wafer lying on the wafer holder and serves to remove particles.

The semiconductor wafer fixed on the wafer holder is not elastically deformed so that the first grinding step results in a flat front which remains intact even after the semiconductor wafer 1 is removed from the wafer holder (FIG. 2*c*). The invention furthermore makes provision for using a wafer receptacle 3 having a hard support 4 in grinding the back 5 of the semiconductor wafer. For this purpose, the semiconductor wafer ground on one side is turned over and the front 2 already ground flat is fixed on the wafer holder 3. Since the front is a flat reference face, the semiconductor wafer is no longer elastically deformed in this operation. As a result of using a wafer holder 3 having a hard support 4, the back 5 of the semiconductor wafer can be ground parallel to the reference face with high precision (FIG. 2*d*). The abrasion produced in this operation can be rinsed off in the grinding machine while the semiconductor wafer is still lying on the wafer holder. The semiconductor wafer 1 retains its flat- and parallel-ground sides even after removal from the wafer holder (FIG. 2*e*).

The edge of the semiconductor wafer is located between the two sides. It can be rounded before or after the grinding of the sides. If the edge is rounded before the sides are ground and consequently still has contamination from the sawing, the semiconductor wafer must be fixed on a wafer holder with a soft support in order to avoid the formation of crow's feet. On the other hand, it is preferable that a semiconductor wafer whose sides are already ground and clean is fixed on a wafer holder having a hard support for rounding the edge.

One side of a semiconductor wafer can also be ground in two steps in which two different grinding tools are used. This is known as the two-spindle grinding method. The first step comprises a coarse grinding; and the second step comprises a fine grinding of the side. In order to be able to utilize the process of the invention for this method, it is first desirable to coarse-grind and then fine-grind both sides of the semiconductor wafer. During the coarse grinding of the sides, the semiconductor wafer is to be fixed on a wafer holder having a soft support. During the fine grinding of the wafer sides, the semiconductor wafer should be fixed on a wafer holder having a hard support.

A semiconductor wafer whose edge and sides have been machined according to the process of the invention is then subjected to a further material-removing treatment which smooths its surface. This may comprise etching and polishing of the semiconductor wafer, with the etching step being optionally deleted. The polishing step may comprise a single-sided polishing of both sides of the semiconductor wafer, or polishing of only one side, or of a double-sided polishing.

Other objects and features of the present invention will become apparent from the following Examples, which disclose the embodiments of the present invention. It should be understood, however, that the Examples are designed for the purpose of illustration only and not as a definition of the limits of the invention.

EXAMPLE

Invention

The effectiveness of the method was tested on silicon wafers having 200 mm diameter. In this connection, the following fabrication sequence was chosen:

wire sawing crude cleaning grinding of the front (wafer holder having a soft support) cleaning of the front in the grinding machine grinding of the back (wafer holder having a hard support)

cleaning of the back in the grinding machine edge rounding (wafer holder having a hard support).

COMPARISON

As a comparison, wafers were fabricated using the same fabrication sequence but with grinding of the front on a wafer holder having a hard support. After a further treatment by etching and double-sided polishing of all the silicon wafers, optical examinations were performed with a "magic mirror". The examinations showed that it was possible to reduce the uneven regions produced during sawing markedly better if the semiconductor wafers were processed according to the invention. The examination also showed that in a treatment according to the invention of the semiconductor wafers adhering particles did not have a negative effect on the treatment result. This was true although the only crudely cleaned semiconductor wafers were appreciably contaminated with particles.

While several embodiments of the present invention have been shown and described, it is to be understood that many changes and modifications may be made thereunto without departing from the spirit and scope of the invention as defined in the appended claims.

What is claimed is:

1. A method of producing a semiconductor wafer having a first flat-ground side and a second flat-ground side and a rounded edge comprising cutting a semiconductor wafer from a single crystal, said wafer being contaminated with particles;

providing a wafer holder having a soft support;

grinding the soft support of the wafer holder at least once to render it even;

fixing the semiconductor wafer on the wafer holder having the soft support, with said soft support having suction channels therethrough, by applying a vacuum to said soft support through said suction channels;

grinding the first side of said wafer to produce said first flat-ground side;

cleansing the soft support of particles after having ground the first side of the wafer; and fixing the first flat-ground side of the semiconductor wafer on a wafer holder having a hard support and grinding the second side of said wafer to produce said second flat-ground side.

2. The method as claimed in claim 1, wherein, after cutting the semiconductor wafer from the crystal, first rounding the edge of the semiconductor wafer, and, during said rounding step, fixing the semiconductor wafer on a wafer holder having a soft support.

3. The method as claimed in claim 1, wherein, after cutting the semiconductor wafer from the crystal, first grinding the sides of the semiconductor wafer and then rounding the edge of the semiconductor wafer, and during rounding of the edge, fixing the semiconductor wafer on a wafer holder having a hard support.

4. The method as claimed in claim 1, comprising only a rough cleaning the semiconductor wafer between cutting and grinding, where particles with a sice of smaller 100 $\mu$m may remain on the wafer surface, without having negative effect in grinding.

5. The method as claimed in claim 3, comprising etching and polishing the semiconductor wafer after grinding of the sides and rounding of the edge.

6. The method as claimed in claim 3, comprising polishing the semiconductor wafer after grinding of the sides and rounding of the edge.

7. A method for producing a semiconductor wafer having two flat-ground sides and a rounded edge by coarse grinding of each side and fine grinding of each side of the wafer, comprising cutting a semiconductor wafer from a single crystal, said wafer being contaminated with particles;

providing a wafer holder having a soft support;

grinding the soft support of the wafer holder at least once to render it even;

fixing the semiconductor wafer on the wafer holder having the soft support during the coarse grinding of each side, and said soft support having suction channels therethrough and by applying a vacuum to said soft support through said suction channels;

cleansing the soft support of particles after coarse grinding of each side; and fixing the semiconductor wafer on a wafer holder having a hard support during the fine grinding of each side.

* * * * *